United States Patent [19]

McMillen

[11] 4,373,577

[45] Feb. 15, 1983

[54] HEAT EXCHANGER ASSEMBLY

[75] Inventor: Russell G. McMillen, Fort Wayne, Ind.

[73] Assignee: International Harvester Co., Chicago, Ill.

[21] Appl. No.: 269,432

[22] Filed: Jul. 21, 1980

[51] Int. Cl.[3] ..... F28F 9/26

[52] U.S. Cl. ..... 165/122; 165/148

[58] Field of Search ..... 165/122, 148

[56] References Cited

FOREIGN PATENT DOCUMENTS

| | | | |
|---|---|---|---|
| 80079 | 2/1920 | Austria | 165/148 |
| 180784 | 1/1907 | Fed. Rep. of Germany | 165/122 |
| 469888 | 12/1928 | Fed. Rep. of Germany | 165/122 |
| 475880 | 6/1915 | France | 165/148 |
| 162170 | 4/1964 | U.S.S.R. | 165/122 |

*Primary Examiner*—William R. Cline
*Assistant Examiner*—Theophil W. Streule, Jr.
*Attorney, Agent, or Firm*—Frederick J. Krubel; F. David AuBuchon

[57] ABSTRACT

A readily fabricated, compact toroidal or radial heat exchanger assembly (10) including fore and aft ring-like distributor tanks (11,12) and a generally circular core assembly (13) sandwiched therein between. The heat exchanger assembly (10) additionally includes a rotary blower (14), positioned radially inwardly of the core assembly (13) and distributor tanks (11,12), which is adapted to draw air axially and force the same radially outwardly through the core assembly (13) and around the distributor tanks (11,12). The ring-like distributor tanks (11,12) are provided with the interior and exterior fins (44,39) which function as heat transfer surfaces and thus the tanks (11,12), per se, are utilized as heat dissipating means along with the core assembly (13). Each distributor tank (11,12) is also formed with a plurality of circumferentially spaced internal baffles or partitions (38) which are oriented with respect to the baffles or partitions (38) of the other distributor tank in such a manner that the liquid coolant is caused to make multiple axial and circumferential passes through the core assembly (13) resulting in considerably increasing the overall efficiency of heat transmission of the heat exchanger assembly (10).

21 Claims, 11 Drawing Figures

HEAT EXCHANGER ASSEMBLY

The radiators or heat exchanger assemblies presently used in conjunction with internal combustion engines of the vast majority of motor vehicles are of square or rectangular shape with a thickness dependent upon the number of rows of tubes used in the core assembly. The radiators generally include a top tank, a core assembly of fins and vertical tubes, and a receiver or bottom tank. The liquid coolant flows under pressure from the engine to the top tank then passes downwardly through the vertical tubes to the bottom tank and then back into the engine. Usually the engine is provided with a fan which is disposed adjacent to one side of the core assembly and operates to suck air from the front of and through the core assembly. The air flowing through the core assembly dissipates the heat being transferred by the fins from the tubes. Inasmuch as the conventional motor vehicle radiator is square or rectangular in shape and the fan blades circumscribe a circular path, the air flow generated by the fan does not pass over the bottom and top tanks nor through the corner areas of the core assembly. Furthermore, radiators presently in use are limited in size or in frontal area by the allowable room within the engine enclosure compartment of the motor vehicle as well as by the effective sweep of the fan across the core assembly.

With the advent of increased power requirements and, consequently, engines of greater horsepower, motor vehicle designers are being confronted with the vexing problem of providing adequate cooling capacity for such larger engines. Increasing the speed and/or the diameter of the fan while increasing the cooling capacity of a given size core frontal area also increases the operating sound or noise and approaches the critical speed limit of the fan. The problem becomes more acute when Governmental Regulations relating to noise pollution and the establishment of permissible noise levels of motor vehicles is taken into account. Some manufacturers have attempted to solve the problem by employing a cross-flow type radiator wherein the liquid coolant flows horizontally across the core assembly rather than vertically as in the conventional motor vehicle engine radiator. However, the cross-flow type radiator design has several limitations of its own. Inherently, it is difficult to get the proper fan sweep of the core assembly because of the required horizontal length (transversely of the vehicle) of the core assembly, as an example.

The problem of providing the proper cooling of motor vehicle engines will become more difficult in the future because of anticipated Department of Transportation Rules and Regulations permitting engines of nearly double the horsepower now employed in motor vehicles. Obviously, such larger engines will require cooling systems having considerably greater heat rejection capacities then now presently available. It is believed that radiators of the type presently available commercially for motor vehicles have reached their ultimate end and cannot be designed in their square or rectangular shape to achieve the cooling requirements of the future.

This invention relates to a new and improved heat exchange assembly and, more particularly, to a generally annular or toroidal radiator wherein a generally annular core assembly is sandwiched between fore and aft liquid coolant distributor tanks, and wherein a rotary blower is encircled by the tanks and core assembly and is capable of drawing cooling air axially and discharging the same radially outwardly through the core assembly and over the exterior of the fore and aft tanks achieving substantially one hundred percent sweep of the heat dissipating surfaces of the heat exchanger assembly.

An important object of the present invention is the provision of a heat exchanger assembly fabricated from a relatively few number of parts and in which the fore and aft distribution tanks serve as heat dissipating means along with the entire core assembly.

Still another object is the provision of a compact, highly efficient, toroidal or generally annular heat exchanger assembly wherein the liquid coolant is caused to flow in an axial direction through the core tubes in multiple passes.

Another object is the provision of a heat exchanger assembly design wherein the core assembly may be increased in area and volume for engines having larger heat dissipation requirements simply by increasing the length of the core assembly while utilizing the same fore and aft distribution tanks, headers, and heat-transmitting core fins.

Because of the inherent compactness of the heat exchanger assembly of the present invention, it obviously has a lower mounted silhouette in the motor vehicle chassis. Consequently, motor vehicle body stylists can take advantage of this compactness feature. By simply lowering the normal hood line required for conventional radiator assemblies, improved driver visibility can be achieved. Additionally, the stylist is allowed to lower the front end sheet metal height for drastic changes in decorative styling of the vehicle body and to aerodynamically streamline the frontal area of the motor vehicle so as reduce air drag and, thus, fuel consumption.

Briefly stated, the heat exchanger assembly of the present invention contemplates the provision of a generally annular radiator or header-core assembly wherein the tubes extend horizontally or axially and are radially and circumferentially spaced. The heat exchanger assembly further includes ring-like fore and aft distribution tanks which are securely fastened to each other and to the radiator core assembly which is sandwiched therein between. The fore and aft tanks are provided with internal and external heat transfer fins as well as radially extending, interior partitions or baffles which partially define a plurality of circumferentially spaced compartments within each tank when secured to the core assembly. Each of the compartments of one distributor tank is in fluid communication with two respective compartments of the other distribution tank. As a result, liquid coolant received within an inlet provided in one of the distribution tanks and which is in fluid communication with one of the compartments of such tank, makes a multitude of horizontal or axial passes through the core assembly before it flows from an outlet provided in a respective one of the compartments which is, in turn, in fluid communication with the engine. The outer periphery of the blower wheel or fan is completely surrounded by the fore and aft distribution tank and radiator core assembly. Thus, air is drawn axially by the blower along the rotational axis thereof and discharged radially outwardly over an area extending approximately 360°. Thus, the air flow is caused to sweep substantially over and about one hundred percent of the exposed exterior surfaces of the core assembly as well as the fore and aft tanks.

The foregoing and other important objects and desirable features inherent in and encompassed by the invention, together with many of the purposes and uses thereof, will become readily apparent from the reading of the ensuing descripton in conjunction with the annexed drawings, in which, FIG. 1 is a front elevational view of a heat exchanger assembly embodying the invention;

Figure 2:
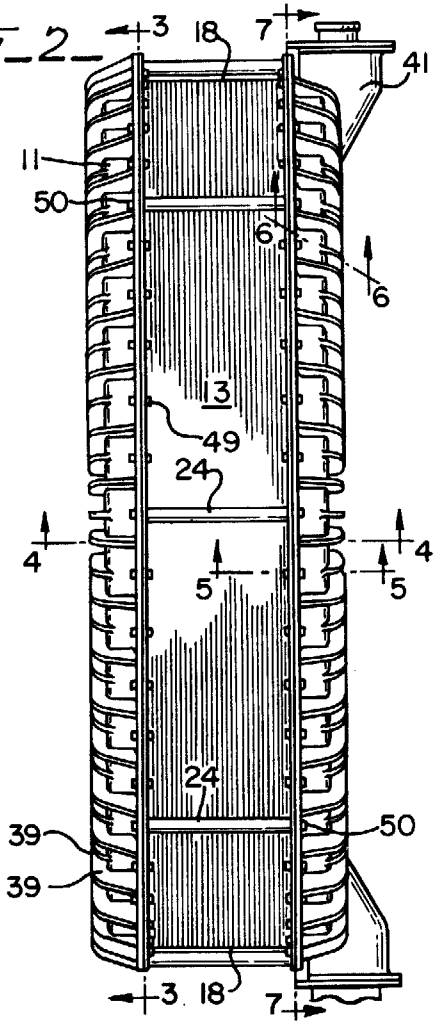
FIG. 2 is a side elevational view of the heat exchanger assembly illustrated in FIG. 1.
Figure 10:
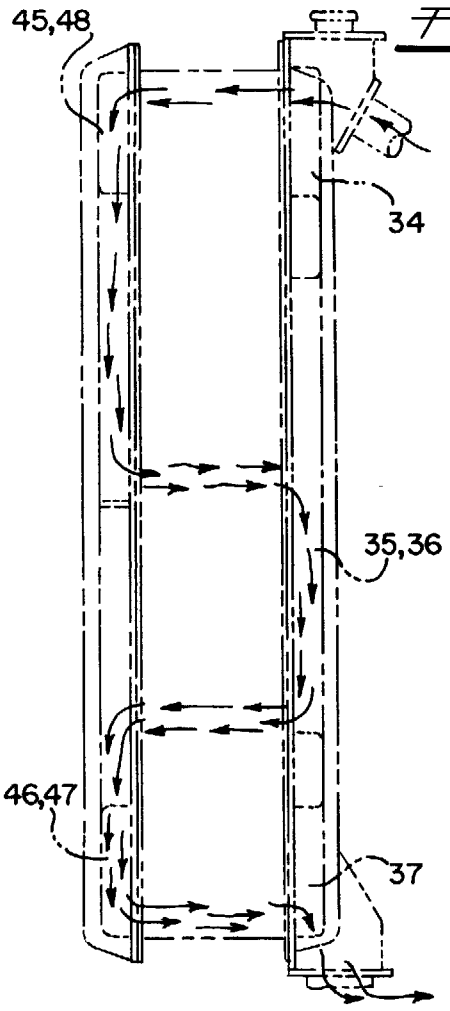
Figures 4, 5, 6, 11:
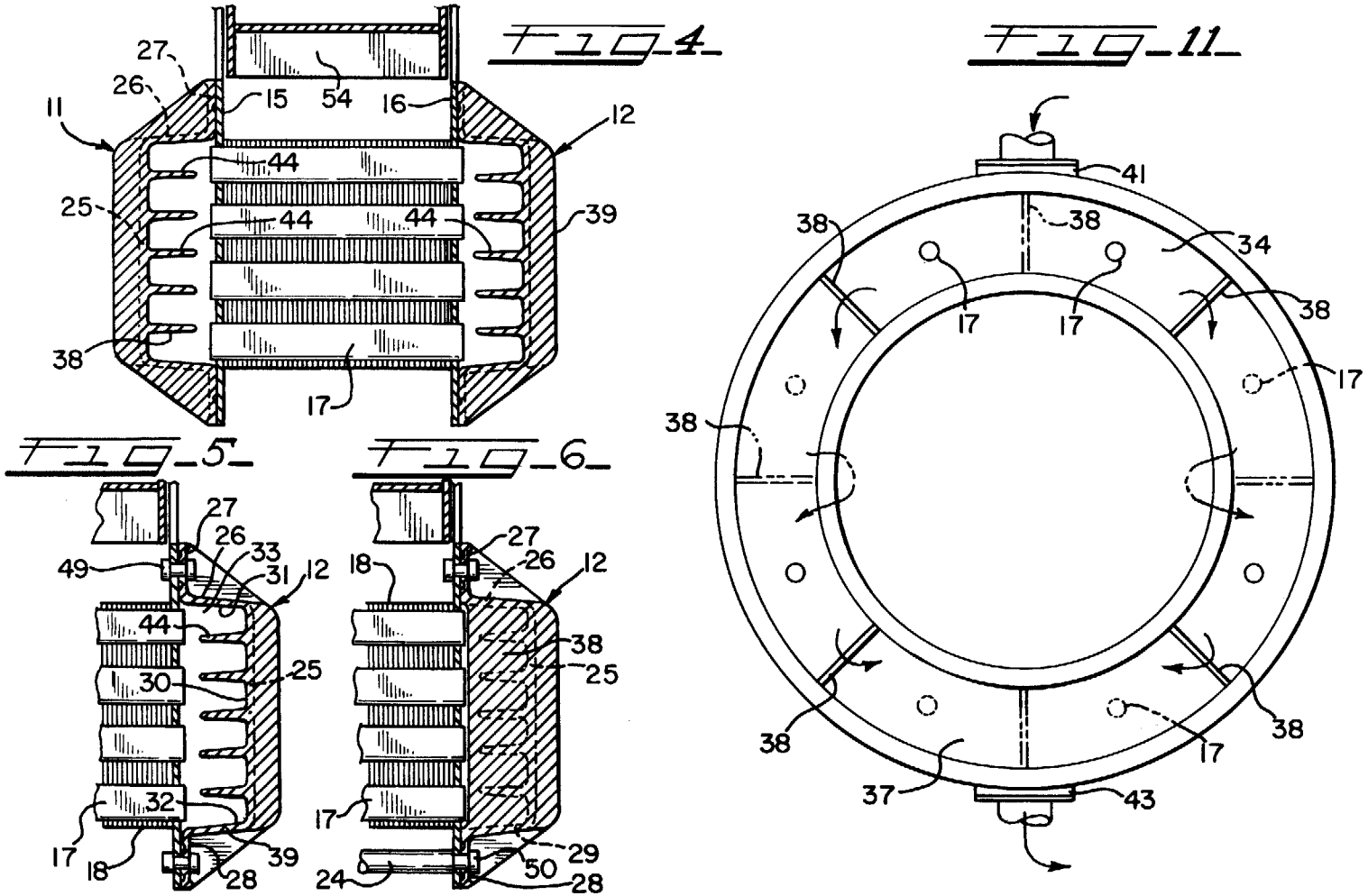
FIG. 4 is a detail radial sectional view taken substantially along line 4,4 of FIG. 2.
Figure 8:
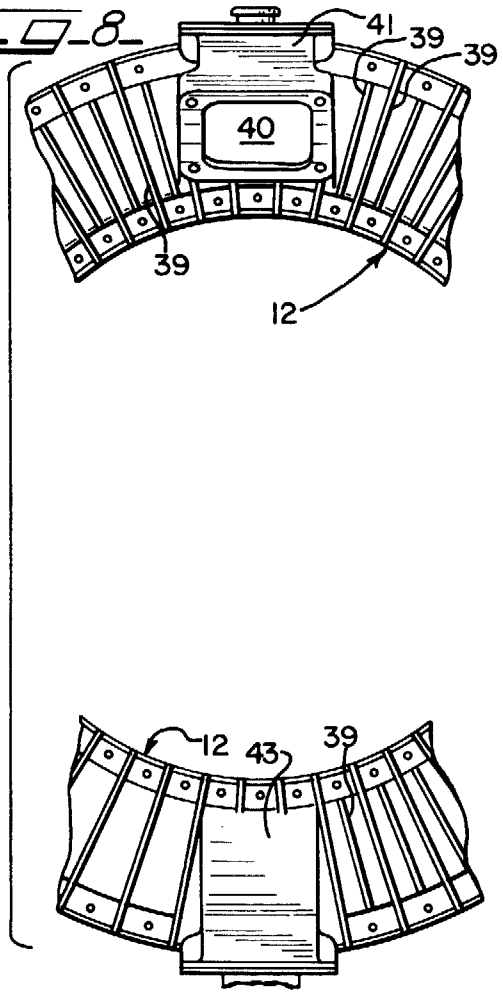
Figure 7:
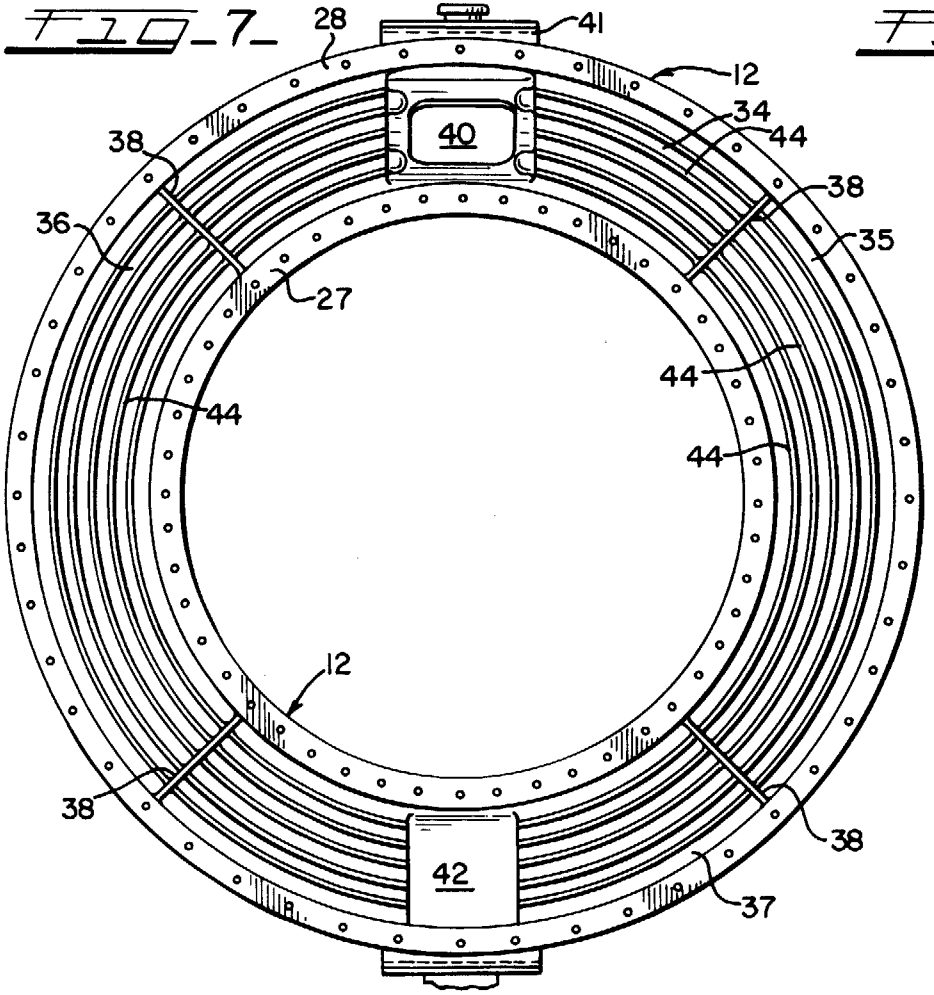
Figure 9:
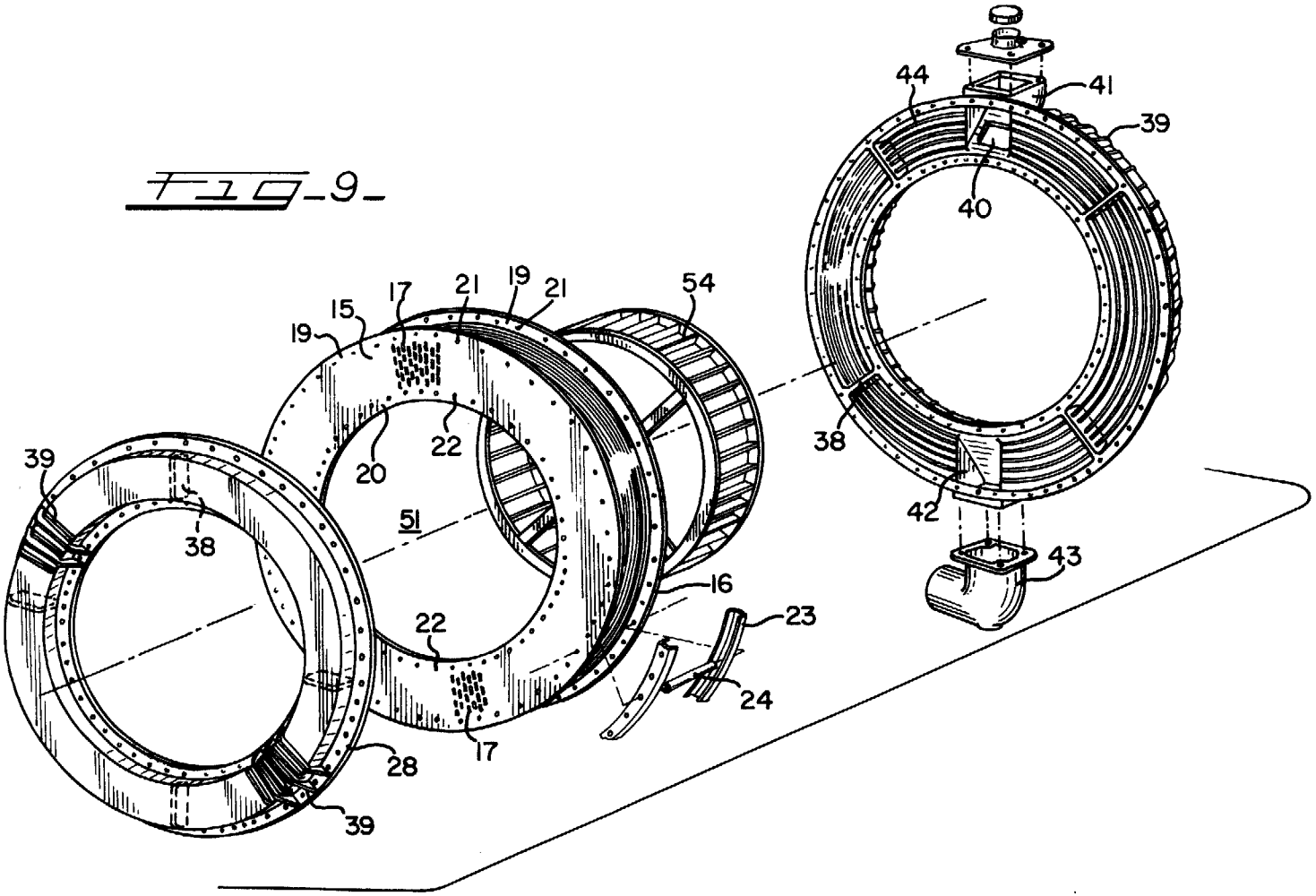

FIGS. 5 and 6 are radial sectional views taken substantially along line 5,5 and line 6,6 respectively, of FIG. 2 illustrating constructional details of the heat exchanger assembly;

FIG. 7 is a vertical sectional view taken substantially along line 7,7 of FIG. 2 illustrating the interior construction of the normally rearwardmost or aft distributor tank in detail;

FIG. 8 is a fragmentary rear elevational view of the aft distribution tank disassembly from the heat exchanger assembly;

FIG. 9 is a exploded perspective view of the heat exchanger construction embodying the invention; and FIGS. 10 and 11 are diagrammatic views illustrating the flow paths of the liquid coolant as it passes through the heat exchanger assembly.

Referring to the drawings in detail, wherein like reference characters represent like elements throughout the various views, a heat exchanger assembly embodying the invention is designated in its entirety by reference numeral 10. The heat exchanger assembly 10 includes four major components; namely, a normally fore distributor tank 11, a normally aft distributor tank 12, a header-core assembly 13, and a blower fan 14.

The header-core assembly 13 includes a pair of spaced, ring-like headers 15, 16 which are preferably made of relatively thin brass or like material. Each of the headers 15 and 16 is provided with a plurality of radially elongated slots therethrough which are adapted to be in axial alignment with the slots formed through the other headers 15, 16. Extending through each pair of aligned header slots is a tube 17, the tubes 17 are suitably secured to the headers 15, 16 and the end portion of each tube 17 projects outwardly beyond a respective one of the headers 15 and 16, as illustrated in FIG. 4. The header-core assembly 13 also includes a plurality of axially spaced and parallel ring-like fins 18 which are positioned between the headers 15 and 16. Each ring-like fin 18 is preferably formed by arranging a plurality of generally arcuately shaped fin segments end-to-end. The fin segments are suitably secured to the tubes 17 which extend through them. Each of the headers 15, 16 has an annular outer peripheral portion 19 which extends radially beyond the outer peripheral edges of the fins 18 and an annular inner portion 20 which projects radially inwardly of the inner peripheral edges of the fins 18. The annular outer portions 19 and the annular inner portion 20 of the header 15 are provided with holes 21, 22, respectively, therethrough which are in axial alignment with respective holes 21, 22 provided in the outer and inner annular portions 19 and 20, respectively, of the other header 16. The holes 21, 22 facilitate the assembly of the heat exchanger assembly 10 as will be pointed out hereinafter.

In order to strengthen and rigidify the heater-core assembly 13, a substantially U-shaped ring 23 is positioned on each of the inwardly facing surfaces of both the inner and outer annular portions 20, 19 of each header 15, 16. Only portions of the U-shaped rings 23 positioned on the inwardly facing surfaces of the outer annular portions 19 of the headers 15, 16 are illustrated in FIG. 9. The outermost rings 23 are provided with openings therethrough corresponding and in alignment with the holes 21 formed through the annular outer portions 19 of the headers 15 and 16 and, in a similar manner, the comparable radially innermost rings, which are not shown in the drawings, are provided with openings in alignment with the holes 22. Extending between each pair of axially spaced rings 23 are a plurality of tubular spacers 24 (only one of which is illustrated in FIG. 9). Each spacer 24 has its ends abutting a resepctive pair of rings 23 and is in alignment with a respective pair of axially aligned openings of the rings 23. The core tubes 17 and the fins 18, which are best illustrated in FIG. 9, are preferably made of copper or other material having comparable heat transmission properties.

As pointed out hereinbefore, the heat exchanger assembly 10 includes a normally aft distributor tank 12 which is best illustrated in FIGS. 7, 8 and 9. The aft distributor tank 12, like the fore distributor tank 11, is preferably made of aluminum. As illustrated in FIG. 5, the annular aft distributor tank 12 is substantially U-shaped in radial section, the annular bight portion 25 thereof lying substantially in a vertical plane and with the radially innermost annular leg 26 extending substantially axially. Extending radially inwardly from and integrally formed with the annular leg 26 of the aft distributor tank 12 is a radial flange 27. A radially outwardly extending flange 28 is similarly formed with the radially outermost annular leg 29 of the aft distributor tank 12. The annular flanges 27, 28 lie substantially in a vertical plane spaced and parallel to the plane containing the annular bight portion 25. From the foregoing, it will be appreciated that the interior surface 30 of the annular bight portion 25 and the annular interior surfaces 31 and 32 of the annular legs 26 and 29, respectively, generally define an annular pocket 33. The annular pocket 33, in turn, is divided into four arcuately extending compartments 34, 35, 36 and 37 by circumferentially spaced, radially extending baffles or partitions 38. The baffles or partitions 38 are preferably integrally formed with the main U-shaped body of the aft distributor tank 12 and each partition 38 extends axially from the interior surface 30 of the bight portion 25 to the plane containing the radial flanges 27, 28. Each partition 38 also extends radially between the interior surfaces 31 and 32 of the annular legs 26 and 29, respectively. It is to be understood that all of the compartments 34, 35, 36 and 37 have substantially the same arcuate length.

As best illustrated in FIGS. 2, 8 and 9, the exterior surface of the aft distributor tank 12 is provided with a plurality of circumferentially spaced, radially extending heat transmitting fins 39. The exterior fins 39, like the interior partitions 38, are preferably integrally formed with the main U-shaped body of the aft distributor tank 12.

As illustrated in FIGS. 7, 8, and 9, the bight portion 25 partially defining the arcuate compartment 34 of the aft distributor tank 12 is provided with a liquid coolant inlet opening 40 therethrough. An enlarged inlet fitting 41 has a portion thereof encircling the inlet opening 40 in order to provide fluid passage for liquid coolant to flow into the aft distributor tank compartment 34. It will be noted from viewing FIG. 7 that the inlet opening 40 is circumferentially spaced substantially midway between the radial partitions 38 partially defining the radial extent of the aft distributor tank compartment 34 and normally the compartment 34 has the highest elevation of all the compartments 34, 35, 36, and 37 when the heat exchanger assembly 10 is in operation.

Similarly, the lowermost wall section of the bight portion 25, as viewed in FIG. 7, of the aft distributor tank 12 which is disposed in the compartment 37 is provided with a liquid coolant outlet opening 42 which, in turn, is encircled by a portion of an enlarged outlet fitting 43 for directing liquid coolant from the aft distributor tank compartment 37 and, hence, the aft distributor tank 12. Preferably, both fittings 41, 43 are integrally formed with and made of the same material as the aft distributor tank 12. It will also be appreciated that the outlet opening 42 is substantially in vertical alignment with the inlet opening 40, as viewed in FIG. 7, and is arcuately spaced substantially midway between the partitions 38 partially defining the radial ends of the aft distributor tank compartment 37.

In order to further enhance the heat transmission efficiency of the heat exchanger assembly 10 of the present invention, a plurality of arcuately extending and radially spaced internal fins 44 are provided in each of the aft distributor tank compartments 34, 35, 36, and 37. As clearly illustrated in FIG. 7, the internal fins 44 are substantially coextensive with the radial lengths of the aft distributor tank compartments 34, 35, 36, and 37, but as shown in FIG. 4, project axially from the interior surface 30 of the bight portion 25 a distance less than the axial distance the annular legs 26, 29 project from the same interior surface 30.

The normally forwardmost or fore distributor tank 11 is constructed similarly to the aft distributor tank 12, described above. However, the fore distributor tank 11 is not provided with structure comparable to the inlet and outlet openings 40, 42, respectively or inlet and outlet fittings 41, 43, respectively. Except for such structural differences the fore and aft distributor tanks 11 and 12 are essentially mirror images of each other, and, therefore, the construction and structure of the fore distributor tank 11 will not be described in detail. It should also be understood that except for the arcuately extending tank compartments 45, 46, 47, and 48, each structural detail of the fore distributor tank 11 is designated with the same reference character as the comparable structural detail of the aft distributor tank 12.

Figure 3:
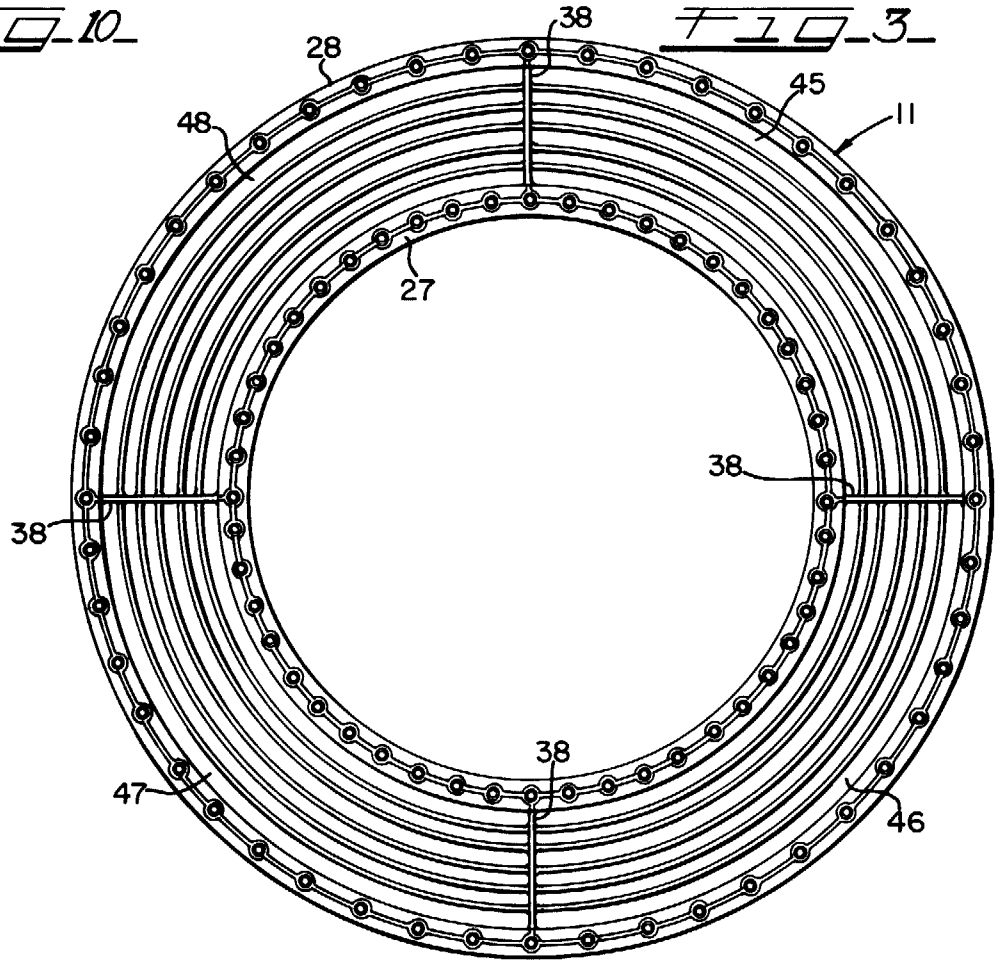
FIG. 3 is a vertical sectional view taken substantially along line 3,3 of FIG. 2 illustrating the interior construction of the normally forwardmost or fore distributor tank in detail.

As evidenced by observing FIGS. 3 and 7 of the interior construction of the fore and aft distributor tanks 11, 12, respectively, while all of the tank compartments have substantially the same arcuate length, the tank compartments 34, 35, 36, and 37 of the aft distributor tank 12 are not in axial alignment with the tank compartments 45, 46, 47, and 48 of the fore distributor tank 11. In other words, a vertical plane passing through the longitudinal axis of the heat exchanger assembly 10 and containing the two partitions 38 defining respective arcuate ends of the tank compartments 45, 46, 47 and 48 passes substantially midway between the arcuate ends of the aft distributor tank compartments 34 and 37. Similarly, a horizontal plane passing through the longitudinal axis of the heat exchanger assembly 10 and containing the partitions 38 defining the arcuate ends of the fore tank compartments 45, 46, 47, and 48 passes through the aft distributor tank compartments 35 and 36 substantially midway between their arcuate ends. From the foregoing, it will be appreciated that when all of the components of the heat exchanger 10 are fully assembled, as shown in FIG. 2, the uppermost tank compartment 34 of the aft distributor tank 12 is not in axial alignment with a single one of the tank compartments of the fore distributor tank 11 but rather arcuately overlaps two of the tank compartments of the fore distributor tank 11, namely, tank compartments 45 and 48. It will also be appreciated that the lowermost tank compartment 37 of the aft distributor tank 12 arcuately overlaps the fore distributor tank compartments 46 and 47. The significance of orienting the baffles or partitions 38 and thus the tank compartments in such a manner will be pointed out hereinafter.

As best shown in FIGS. 2, 5 and 6 the fore distributor tank 11, aft distributor tank 12, and header-core assembly 13 are assembled together by means of suitable nut and bolt means, designated generally by reference character 49, and elongated bolt and nut means 50 associated with the tubular spacers 24. The outer and inner peripheral edge portions 19, 20 respectively, of header 15 abut the outer and inner radially extending legs 28, 27, respectively of the fore distribution tank 11. Suitable gasket means (not shown) are provided between such abutting surfaces in order to provide a fluid-tight seal therebetween. In a similar manner the inner peripheral edge portion of the header 16 abuts the radially inwardly extending flange 27 on leg 26 of the aft distributor tank as shown in FIG. 5. The radially outwardly extending flange 28 integrally formed with the leg 29 of aft distributor tank 12 is firmly clamped or secured to the outer peripheral edge portion 19 of the header 16. Annular gasket means of the same kind as provided between the annular joints between the fore distributor tank 11 and the header-core assembly 13 are also provided between the engaging surfaces of the header 16 of the head-core assembly 13 and the aft distributor tank 12 so as to make such annular joints fluid-tight. The fore and aft distributor tanks 11 and 12 and the header-core assembly 13 are further firmly fastened together by means of the elongated bolt and nut means 50, the bolts of which extend through the tubular spacers 24 which are circumferentially spaced around the header-core assembly 13 and extend in an axial direction. The tubular spacers 24 maintain the proper spacing between the headers 15 and 16 and also serve to strengthen and rigidify the header-core assembly 13 once the elongated bolt and nut means 50 are securely tightened. From the foregoing, it will be appreciated that the assembled heat exchanger structure thus far described is relatively light in weight and compact in size and can be readily assembled without the need of any special tools or equipment of the like. Moreover, the heat transmission capacity of the heat exchanger assembly may be readily varied by simply varying the thickness or axial length of the header-core assembly 10 and without the need of changing the diameter thereof. Furthermore, the same fore and aft distributor tanks 11 and 12 may be used with the new header-core assembly 13.

When the heat exchanger components thus far described are assembled as shown in FIG. 2, one end of each of the core tubes opens into a respective one of the fore distributor tank compartments 45, 46, 47, or 48 and the opposite end of such core tube 17 is in fluid communication with a respective one of the aft distributor tank compartments 34, 35, 36 or 37. Thus, in operation, the coolant whose temperature is to be lowered is received in the aft distributor tank compartment 34 through the inlet opening 40 provided in the wall of such compartment. The coolant then flows axially forwardly through those core tubes 17 which have an end in fluid communication with the aft distributor tank compartment 34 as diagrammatically illustrated in FIG. 10. Because of the angular orientation of the compartments 34, 35, 36 and 37 of the aft distributor tank 12 with respect to the fore distributor tank compartments 45, 46, 47 and 48, as pointed out hereinabove, approximately one-half of the coolant flowing axially forwardly through such core tubes 17 enters fore distributor tank compartment 45 and the other half of such coolant flowing through such core tubes 17 enters fore distributor tank compartment 48. Thus, in effect, the coolant entering the aft distributor tank compartment 34 is divided or split into two streams of equal volume; one stream flowing axially forwardly to compartment 45 and the other stream axially flowing forwardly to compartment 48 of the fore distributor tank 11. Each of the streams then, in effect, flows arcuately downwardly. The coolant received in the fore distributor tank compartment 48 then flows axially rearwardly to the aft distributor tank compartment 35 through respective core tubes 17 extending between and providing fluid communication between such compartments 48 and 35. In a similar manner, the core tubes 17 extending between and providing fluid communication between the fore distributor tank compartment 45 and the aft distributor tank 36 serve as passage means for the flow of the coolant between such compartments 45 and 36. The coolant received in the aft distributor tank compartment 36 again reverses its direction of flow 180° and flows axially forwardly through certain of the core tubes 17 to the fore distributor tank compartment 46 and, similarly, the coolant received in the aft distributor tank 35, after flowing arcuately downwardly, flows axially and in a forward direction into the fore distributor tank compartment 47. The coolant streams received in the fore distributor tank compartments 46 and 47, respectfully, from the aft distributor tank compartments 36, 35 flow arcuately downwardly and then axially rearwardly through certain core tubes 17 into the aft distributor tank compartment 37 where they merge. The coolant received in the aft distributor tank compartment 37 from the fore distributor tank compartments 46 and 47 then flows or is discharged through the outlet opening 42 to the engine or other machine or device requiring the cooling media.

Figure 1:
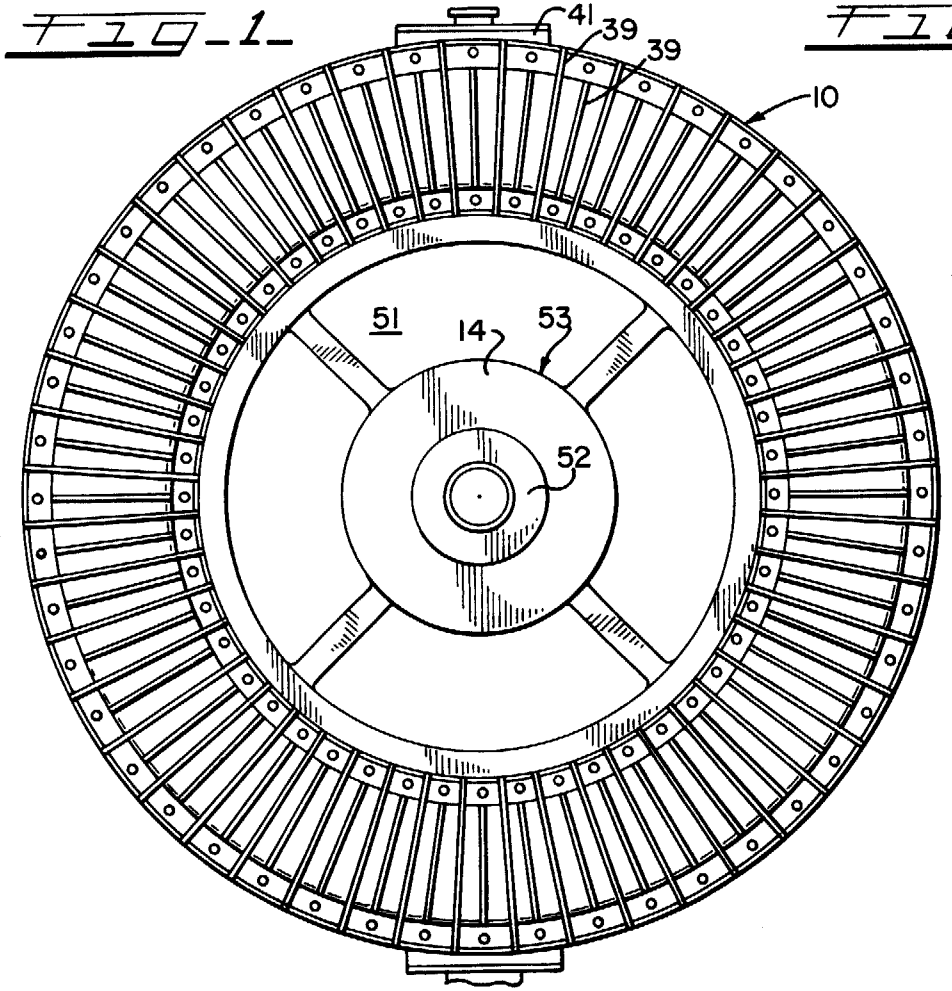

As best illustrated in FIGS. 1 and 9, the innermost peripheral annular surfaces of the fore and aft distributor tanks 11 and 12, respectively, and the header-core assembly 13 generally define the annular outer limit of a fan rotor compartment, designated generally by reference character 51. The rotary blower fan 14 is arranged within the fan rotor compartment 51 and is preferably a centrifugal type or one in which air is drawn axially into the fan and is discharged, under pressure, radially outwardly. The hub 52 of fan rotor, which is designated in its entirety by reference character 53, is adapted to be attached to a rotary drive shaft (not shown) which, in turn, is drivingly connected to a prime mover by any suitable conventional power transmission means. The mechanism and means for rotating the fan rotor 53 forms no part of the present invention.

In operation, cooling air is drawn axially rearwardly through the rotary blower fan 14 and is discharged radially outwardly, under pressure, by the fan impeller blades 54. It will be appreciated that the cooling air discharged by the fan impeller blades 54 flows around the core tubes 17 and through the radial spaces or passageways defined by the header-core heat-transmitting fins 18 so as to dissipate the heat of the fluid being circulated in the heat exchanger assembly 10. The fan-generated air stream is also caused to flow through the radial spaces between and over the exterior heat-transmitting fins 39 provided on the exterior of the fore and aft distributor tanks 11, 12, respectively. The rotary blower fan 14 delivers substantially all of the air it receives axially in a radial direction through the radial spaces between the fins 18 and around the axially extending tubes 17 and over the exterior heat-transmitting fins 39. Thus, substantially all of the cooling air which is moved by the blower fan 14 through and around the heat exchanger structure is brought into relatively close heat exchange relationship with the fluid being cooled. Moreover, the cooling air flowing through the header-core assembly 13 and over the fore and aft distributor tanks 11, 12, respectively, is substantially unobstructed, and this provides a more efficient heat exchange system.

From the foregoing, it will be appreciated that the internal arcuate heat-transmitting fins 44 of the fore and aft distributor tanks 11 and 12 not only contribute to a more intimate heat transfer relation between the liquid coolant or fluid being circulated within the distributor tank compartments and the cooling air but also cause the liquid coolant to flow more uniformly and smoothly without turbulence in such distributor tank compartments to further enhance the transfer of heat. The heat exchange efficiency is further increased by virtue of the fact that the liquid coolant travels in circuitous paths through the heat exchanger assembly 10 thereby increasing the time in which it and the cooling air are in heat exchange relation. By providing the fore-and aft distributor tanks 11, 12, respectively, with internal fins 44 and exterior fins 39 in the manner pointed out hereinbefore, the fore and aft distributor tanks, in effect, function as efficient heat-transmitting means and not merely as a means for collecting and distributing liquid coolant as in conventional heat exchanger structures. Moreover, since the amount of heat transferred is proportional to the product of the heat exchange surface area and the amount of air moving through and over such heat exchange surface area in a given time interval, it will be appreciated that, in comparison to conventional heat exchange units, the amount of heat transfer by the heat exchange assembly 10 of the present invention is markedly greater. Substantially all of the available heat exchange surface area is used efficiently and such available heat exchange surface area is maximized by the unique structure of the fore and aft distributor tanks 11 and 12 and the arrangement of such distributor tanks with respect to the other components of the heat exchanger assembly 10.

It is to be understood that while reference was made to the desirability of applying the heat exchange assembly of the present invention to a motor vehicle such as a truck or the like, it can also be advantageously applied to any type of vehicle employing any type of heat-generating engine, whether of the internal or external combustion type or to any other heat exchange system, whether portable or stationary, and whether used in conjunction with an engine or not.

The embodiment of the invention chosen for the purposes of description and illustration herein is that preferred for achieving the objects of the invention and developing the utility thereof in the most desirable manner, due regard being had to existing factors of economy, production methods, and the improvements sought to be affected. It will be appreciated, therefore, that the particular structural and functional aspects emphasized herein are not intended to exclude, but rather to suggest, such other adaptations and modifications of the invention as fall within the spirit and scope of the invention as defined in the appended claims.

What is claimed is:

1. A heat exchanger assembly comprising:

a heat exchange means disposed about a central axis, said heat exchange means including:

fluid inlet means for introducing a fluid into the interior of said heat exchange means, fluid outlet means spaced from said fluid inlet means for discharging fluid from the interior of said heat exchange means, and fluid passageway means extending between and providing a fluid path between said fluid inlet means and said fluid outlet means, said fluid passageway means including a plurality of first elongatetd segment means lying generally in a first plane perpendicular to said central axis, a plurality of spaced segment means extending substantially parallel with respect to said central axis, one end of each of said spaced segment means being in fluid communication with a respective portion of a respective one of said elongated segment means, said fluid inlet means being in fluid communication with a portion of a respective first one of said first elongated segment means, said segment portion of said respective first one of said first elongated segment means being spaced intermediate the ends thereof, and said fluid passageway means further including a plurality of second elongated segment means lying generally in a second plane perpendicular to said central axis and axially spaced and parallel with respect to said first plane, and one end of each of said spaced segment means being in fluid communication with a respective portion of a respective one of said second elongated segment means.

2. A heat exchanger assembly as set forth in claim 1, further including a rotary fan generally encircled by said heat exchange means for causing cooling air to flow over said fluid passageway means when in operation, the rotational axis of said fan being substantially coincident with said central axis of said heat exchange means.

3. A heat exchanger assembly as set forth in claim 1, wherein said heat exchange means is generally annular in shape, and wherein said fluid inlet means is circumferentially spaced from said fluid outlet means.

4. A heat exchanger assembly as set forth in claim 4, wherein said fluid outlet means is spaced diametrically opposite said fluid inlet means and is in fluid communication with a portion of a respective second one of said first elongated segment means, said segment portion of said second one of said first elongated segment means being spaced intermediate the ends thereof, said fluid passageway means further includes a third one of said first elongated segment means circumferentially interposed between said first one and said second one of said first elongated segment means and wherein each of said first one second one, and third one of said first elongated segment means is generally arcuate in shape.

5. A heat exchanger assembly as set forth in claim 4, further including, a rotary blower fan generally encompassed by said heat exchange means for causing cooling air to flow generally in a radially outward direction over said fluid passageway means when in operation, the rotational axis of said fan being substantially coincident with said central axis of said heat exchange means.

6. A heat exchanger assembly as set forth in claim 4, further including, a second fluid passageway means extending between and providing a second path for fluid to flow between said fluid inlet means and said fluid outlet means, said second fluid passageway means including said first one and said second one of said first elongated segment means, and a fourth one of said first elongated segment means circumferentially interposed between said first one and said second one of said first elongated segment means.

7. A heat exchanger assembly as set forth in claim 6, wherein said second fluid passageway means includes a plurality of second spaced segment means extending substantially parallel with respect to said central axis, one end of each of said second spaced segment means being in fluid communication with a respective portion of a respective one of said second elongated segment means.

8. A heat exchanger assembly as set forth in claim 7, wherein said third one of said first elongated segment means and said fourth one of said first elongated segment means lie generally in a common plane perpendicular to said central axis.

9. A heat exchanger assembly as set forth in claim 8, further including, a rotary blower fan generally encircled by said heat exchange means for causing cooling air to flow generally in a radially outward direction over said first and said second fluid passageway means when in operation, the rotational axis of said fan being substantially coincident with said central axis of said heat exchange means.

10. A heat exchanger assembly comprising:

a generally annular header-core assembly having a central axis including a plurality of axially extending tubes arranged in a circular row, said tubes being circumferentially spaced with respect to each other in said row;

a generally annular fore distributor tank;

means for forming a plurality of generally arcuately extending fluid-receiving first compartments arranged end-to-end in said fore distributor tank;

means for operatively connecting said fore distributor tank to one axial side of said header-core assembly whereby each of said tubes is in fluid communication with a respective one of said first compartments;

a generally annular aft distributor tank;

means for forming a plurality of generally arcuately extending fluid-receiving second compartments arranged end-to-end in said aft distributor tank;

means for operatively connecting said aft distributor tank to the axial side of said header-core assembly opposite said fore distributor tank whereby each of said tubes is in fluid communication with a respective one of said second compartments;

fluid inlet means for introducing a fluid into the interior of said header-core assembly; and fluid outlet means circumferentially spaced from said fluid inlet means for discharging fluid from the interior of said header-core assembly.

11. A heat exchanger assembly as set forth in claim 10, wherein each of said second compartments is substantially in axial alignment with approximately one-half of each of said first compartments of a respective pair of arcuately adjacent first compartments of said fore distributor tank.

12. A heat exchanger assembly as set forth in claim 11, wherein said axially extending tube means includes a plurality of axially extending tubes arranged in a plurality of radially spaced rows with the tubes of each row being circumferentailly spaced with respect to each other and the tubes of the next radially adjacent row.

13. A heat exchanger assembly as set forth in claim 12, wherein said annular header-core assembly includes a pair of ring-like, axially spaced headers generally defining the axial limits of said header-core assembly, said tubes extending axially through and being secured to said headers.

14. A heat exchanger assembly as set forth in claim 13, wherein said header-core assembly further includes a plurality of relatively thin, axially spaced, ring-like fin means arranged between said headers, said tubes extending through and being in heat-transmitting relationship with said fin means.

15. A heat exchanger assembly as set forth in claims 10 or 14, wherein each of said first and second compartments has interiorly disposed, heat-transmitting fin means projecting inwardly from an interior wall surface portion thereof; and further including exteriorly disposed, heat-transmitting fin-means projecting outwardly from an exterior wall surface portion of each of said fore and aft distributor tanks.

16. A heat exchanger assembly as set forth in claim 14, wherein each of said first and second compartments has a plurality of interiorly disposed, heat-transmitting fins projecting substantially axially from an interior wall surface portion thereof, said interiorly disposed fins of each of said compartments being radially spaced with respect to each other and extending substantially arcuately within the compartment.

17. A heat exchanger assembly as set forth in claims 14 or 16, further including a plurality of exteriorly disposed, heat-transmitting fins projecting outwardly from an exterior wall surface portion of each of said fore and aft distributor tanks, said exteriorly disposed fins lying generally in planes containing said central axis and the fins of each of said fore and aft distributor tanks being circumferentially spaced with respect to each other.

18. A heat exchanger assembly as set forth in claim 14, wherein each of said first and second compartments has a plurality of interiorly disposed, heat-transmitting fins projecting substantially axially from an interior wall surface portion thereof, said interiorly-disposed fins of each of said compartments being radially spaced with respect to each other and extending substantially arcuately within the compartment, and further including a plurality of exteriorly disposed, heat-transmitting fins projecting outwardly from an exterior wall surface portion of each of said fore and aft distributor tanks, said exteriorly disposed fins lying generally in planes containing said central axis and the fins of each of said fore and aft distributor tanks being circumferentially spaced with respect to each other; and a rotary fan generally encompassed by said header-core assembly and said fore and aft distributor tanks for causing cooling air to flow between said fin means arranged between said headers and over said tubes when in operation, the rotational axis of said fan being substantially coincident with said central axis of said header-core assembly.

19. A heat exchanger assembly as set forth in claim 18, wherein said rotary fan is a blower type whereby cooling air is caused to flow generally in a radially outward direction between said fin means and over said tubes when in operation.

20. A heat exchanger assembly as set forth in claim 19, wherein each of said fore and aft distributor tanks has a substantially U-shaped section so as to provide a substantially annular, radially extending bight portion and a pair of radially spaced, axially extending leg portions, the free ends of said leg portions of each of said fore and aft distributor tanks abutting a respective one of said pair of headers and being secured thereto in a fluid-tight manner by a respective one of said means for operatively connecting said aft distributor tank to said header-core assembly and said means for operatively connecting said fore distributor tank to said header-core assembly, and said interiorly disposed, heat-transmitting fins projecting substantially axially from the interior surfaces of said bight portions of said fore and aft distributor tanks.

21. A heat exchanger assembly comprising:

a generally annular header-core assembly including a pair of ring-like axially spaced headers generally defining the axial limits of said header-core assembly;

a plurality of tubes extending axially between and having their ends passing through and secured to said headers, said tubes being arranged in a plurality of radially spaced rows with the tubes of each row being circumferentially spaced with respect to each other and the tubes of the adjacent row, and said header-core assembly further including a plurality of relatively thin, axially spaced ring-like fin means arranged between said headers, said tubes extending through and being in heat-transmitting relationship with said fin means;

a generally annular fore distributor tank having a substantially U-shaped section so as to provide a substantially annular, radially extending bight portion and a pair of radially spaced, axially extending leg portions, the free ends of said leg portions abutting one of said pair of headers and being secured thereto in a fluid-tight manner, the interior surfaces of said bight and leg portions and the outwardly facing surface of said one of said pair of headers defining an annular first pocket, and a plurality of radially extending, circumferentailly spaced partitions in said first pocket to divide the same into a plurality of arcuately extending first compartments arranged end-to-end;

a generally aft distributor tank having a substantially annular, radially extending bight portion and a pair of radially spaced axially extending leg portions, the free ends of said leg portions abutting the other one of said pair of headers and being secured thereto in a fluid-tight manner, the interior surfaces of said bight and leg portions and the outwardly facing surface of said other one of said pair of said headers defining an annular second pocket, and a plurality of radially extending, circumferentially spaced partitions in said second pocket to divide the same into a plurality of arcuately extending second compartments arranged end-to-end, each of said second compartments being substantially in axial alignment with approximately one-half of each of said first compartments of a pair of arcuately adjacent first compartments of said fore distributor tank;

fluid inlet means associated with a respective one of said second compartments for introducing fluid into the heat exchanger assembly; and fluid outlet means associated with a respective one of said second compartments for discharging fluid from the heat exchanger assembly, said fluid outlet means being circumferentially spaced diametrically opposite said fluid inlet means.

* * * * *